US005253908A

United States Patent [19]

Leonard, III

[11] Patent Number: 5,253,908

[45] Date of Patent: Oct. 19, 1993

[54] COMMODE STALL DOOR LATCH

[76] Inventor: Patrick J. Leonard, III, 1904 Lynn Tree Ct., High Point, N.C. 27265

[21] Appl. No.: 16,297

[22] Filed: Feb. 11, 1993

[51] Int. Cl.[5] ..... E05C 19/18

[52] U.S. Cl. ..... 292/289; 292/258

[58] Field of Search ..... 292/289, 292, 295, 288, 292/307 R, 251, 258

[56] References Cited

U.S. PATENT DOCUMENTS

| | | | |
|---|---|---|---|
| 2,440,798 | 5/1948 | Hardwick | 292/288 |
| 2,536,941 | 1/1951 | Jones | 292/288 |
| 2,608,711 | 9/1952 | Moore | 292/288 X |
| 4,022,503 | 5/1977 | Bey | 292/288 X |
| 4,326,394 | 4/1982 | Stein | 292/292 X |
| 4,712,816 | 12/1987 | Mueller | 292/288 X |

FOREIGN PATENT DOCUMENTS

| | | | |
|---|---|---|---|
| 8480 | 1/1990 | Japan | 292/288 |

*Primary Examiner*—Richard E. Moore

[57] ABSTRACT

A portable door latch is used on commode stall doors in bathrooms in which the stall door latches have been broken or undermaintained. The easy-to-use device includes a pair of disk-like members which are affixed on a nylon line for sandwiching the door against the jamb from inside the stall during use. When the user desires to exit the stall, the device is easily loosened and removed for storage in the pocket of the user.

11 Claims, 2 Drawing Sheets

COMMODE STALL DOOR LATCH

BACKGROUND OF THE INVENTION

1. Field of the Invention

The invention herein pertains to a portable door latch and particularly to a door latch for use on swingable doors as found on bathroom commode stalls in municipal buildings.

2. Background and Objectives of the Invention

Bathrooms in office buildings, airports, schools and other public or private buildings oftentimes provide multiple private commode stalls which include panel walls having a swingable front door affixed thereto. During original installation of the stalls the doors generally include a door catch or latch which can be operated from inside the stall to insure privacy during use. Vandalism and use takes its toll on the door catch mechanisms and usually within a relatively short span of time the catch will either be broken or removed from the door. When such occurs the patrons have less privacy as the door can be easily opened by those seeking an empty stall, oftentimes much to the user's embarrassment. While some stalls can be manually held closed during use, it has been realized that a simple, portable latch would be quite useful to those that must frequently use public bathrooms. Salesmen, office workers, tourist and the like have the need for a portable latch which can be carried on one's person and placed in operation on the stall door and thereafter removed quickly.

It is therefore one objective of the present invention to provide a small, portable commode stall latch which can be easily carried by a person for use from time to time as needed.

It is still another objective of the present invention to provide a commode stall door latch which will work on a variety of swingable stall doors.

It is yet another objective of the present invention to provide a commode stall door latch which is relatively easy to manufacture and which can be purchased at a relatively low price by consumers.

It is still another objective of the present invention to provide a commode stall door latch which includes a pair of disks for securely sandwiching a commode stall door therebetween.

Various other objectives and advantages of the present invention will become apparent to those skilled in the art as a more detailed description is set forth below.

SUMMARY OF THE INVENTION

The aforesaid and other objectives are realized by providing a lightweight commode stall door latch which includes a flexible cord as may be formed from nylon and which has a rigid disk-like member affixed at one end thereof. Slidably positioned on the cord is a second similar disk-like member. A means to secure the second disk-like member against the inside face of the door and door jamb in the form of a spring-loaded catch allows the inside disk-like member to be held against the inside face of the door as the first disk-like member is in contact with the outside door face and jamb. The cord passes within the gap between the door and the door jamb. When the occupant desires to exit the stall the catch is loosened and the door opened whereupon the latch can then be placed in one's pocket or pocketbook for storage purposes until needed again.

DESCRIPTION OF THE PREFERRED EMBODIMENT

Figure 1:
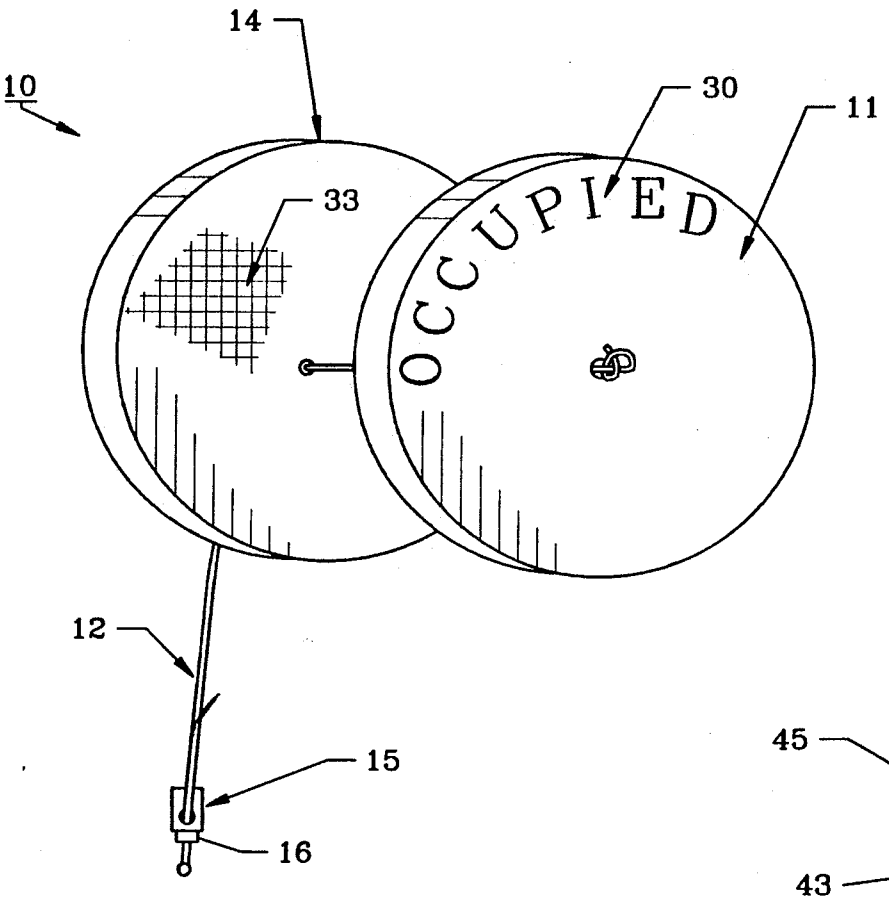
FIG. 1 shows a perspective view of a commode stall door latch of the present invention.

The preferred form of the invention is illustrated in FIG. 1 in which a pair of rigid plastic disk-like members are positioned on a nylon cord. The disk-like members may have a diameter of approximately two and one-half inches, a thickness of one-quarter of an inch and may have a center opening to allow a one-eighth inch nylon guideline cord to easily pass therethrough. The first or outer door face member is rigidly affixed at the terminal end of the nylon guideline whereas the second or inside door face member is slidably positioned thereon. A conventional securing means comprising a spring-loaded catch allows the disk-like members to tightly sandwich the door therebetween to secure the door in place in closed fashion. The disk-like members may be formed of a rigid plastic such as a polycarbonate or the like and along the inside disk faces, for positioning against the door and jamb surfaces, a friction producing rubber or similar surface is provided to prevent disk slippage during use. When the occupant is ready to exit the stall, the catch is slid rearwardly, away from the inside door face to allow the inside disk-like member to be removed from the door face and the door opened. Thereafter, the disk-like member and nylon cord are placed in the user's pocket or otherwise for later use as required.

DETAILED DESCRIPTION OF THE DRAWINGS AND OPERATION OF THE INVENTION

For a more complete understanding of the invention and its use, turning now to the drawings, door latch 10 is shown in FIG. 1 which can be used on commode stall doors as are conventionally found in bathrooms of municipal buildings, schools, airports and other buildings. Such bathrooms usually have a plurality of commode stalls which are intended to afford privacy for the user. However, due to vandalism, and wear and tear over prolonged periods, the swingable doors oftentimes afford little privacy for the user as the mechanical latches originally installed are generally missing or broken. To provide privacy for such stalls, the invention illustrated herein presents a portable door latch which can be easily carried by tourists, salesmen, travelers and others who must frequently use these poorly maintained stalls and receive the degree of privacy originally intended. As seen in FIG. 1, door latch 10 includes a circular or disk-like member 11 which as will be hereinafter explained provides a means for attachment to the outside face of a conventional commode stall door. Member 11 is positioned at the end of a flexible nylon guideline 12 which may be for example, one-eighth inch in diameter and fourteen inches in length to easily slide between the door jamb and door. Knot 13 has been tied at one end of guideline 12 to prevent member 11 from slipping therefrom. As would be understood, disk-like member 11 could also be glued or otherwise attached to the end of guideline 12 and acts as a means to engage an outside door face. Slidably positioned on guideline 12 is a second similar disk-like member 14 which acts as a means to adjustably engage the inside face of a commode stall door and jamb. A conventional spring-loaded catch 15 is also slidably positioned on guideline 12 and acts as a securing means. Spring-loaded plunger 16 of catch 15 can be depressed to allow catch 15 to be moved along guideline 12. When plunger 16 is released, catch 15 is then locked at the desired position along guideline 12.

Figure 2:
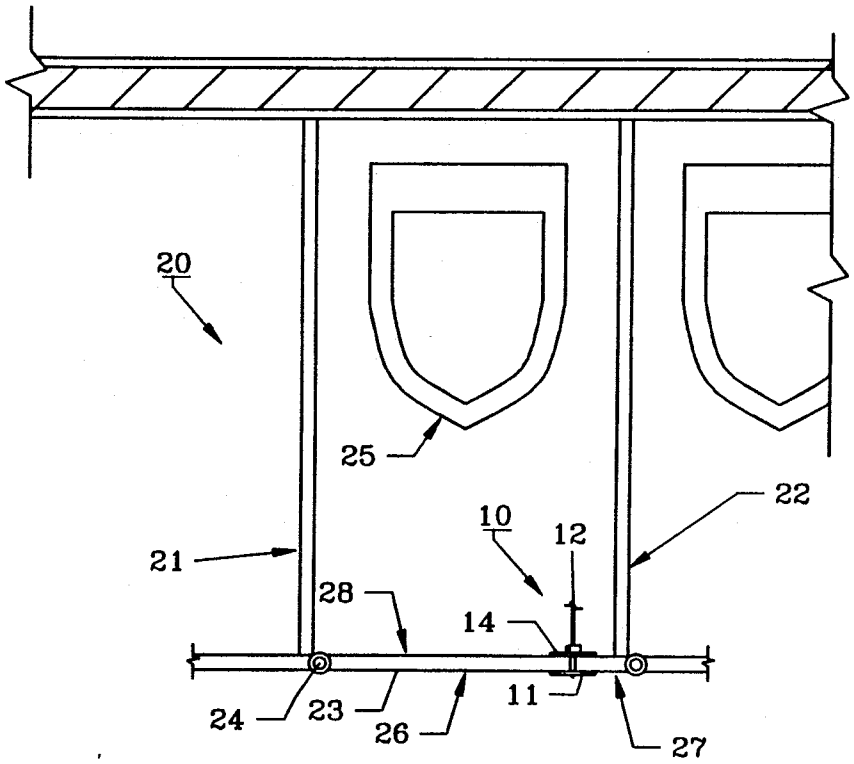
FIG. 2 illustrates a top plan view of the door latch as shown in FIG. 1 in place on a conventional commode stall door.

In use, commode stall 20 as seen in FIG. 2 as may be one of a plurality of commode stalls generally found in airport bathrooms or the like. Commode stall 20 includes left side panel 21, right side panel 22, and swingable door 23 attached to left panel 21 by hinge 24. As would be understood, door 23 may have had a mechanical catch or latch originally affixed so the user could latch door 23 while using commode 25 but due to vandalism or the like door 23 currently does not. The user, when entering commode stall 20 can then place disk-like member 11 against outside door face 26 and door jamb 27 and extend guideline 12 inwardly along the space between door 23 and door jamb 27. With guideline 12 so positioned, second disk-like member 14 can be urged along guideline 12 until it contacts inside door face 28 as shown in FIG. 2. With second disk-like member 14 so positioned, catch 15 is then slid along guideline 12 by depressing plunger 16 until it securely abuts disk-like member 14. By releasing plunger 16, catch 15 then holds door 23 between disk-like members 11 and 14 and provides privacy for the user of commode stall 20. Indicia 30 as shown in FIG. 1 may be placed on member 11 to inform other patrons that stall 20 is in use. Bright colors or other words other than "OCCUPIED" as shown in FIG. 1 may also provide attention thereto and demonstrate to observers the occupied status.

Figure 4:
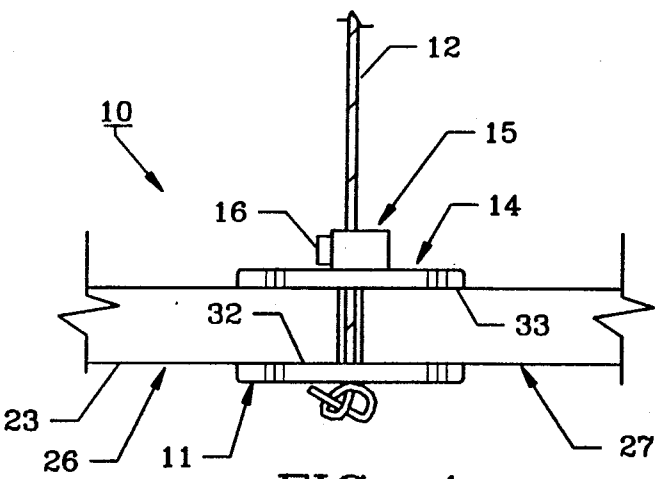
FIG. 4 pictures a close-up view of the door latch as seen in FIG. 2 on the commode stall door.

Disk-like members 11 and 14 can be formed from a variety of materials such as wood, metals such as aluminum or plastics to perform satisfactorily. However, with slick materials the inside surfaces 33 of disk-like member 14 as shown in FIG. 4 and inside surface 32 of disk 11 should be coated with a friction producing surface such as rubber or abrasive strips to improve the holding ability. Other materials than those mentioned above may also be used to form disk-like members 11 and 14 such as polyvinylchloride (PVC) or other relatively soft, pliant polymeric materials.

Figure 3:
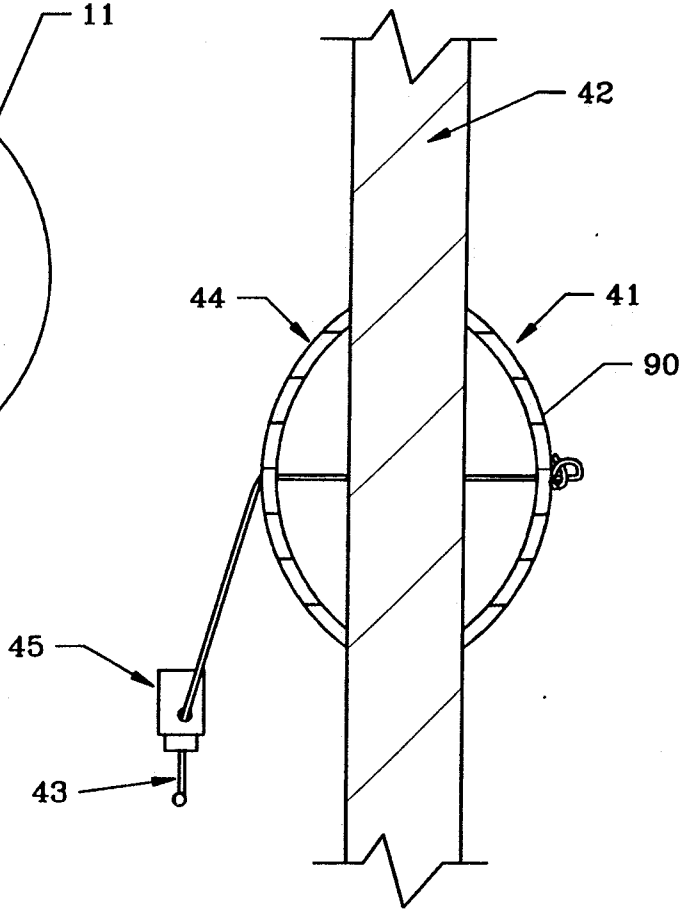
FIG. 3 demonstrates yet another embodiment of the invention as shown in FIG. 1.

In FIG. 3 outside disk-like member 41 and inside disk-like member 44 are shown which have a slight opposing concave configuration when first positioned against door 42. As flexible guideline 43 is tightened, catch 45 which is a conventional spring-loaded catch positioned on guideline 43 is forced against inside disk-like member 44. Members 41 and 44 then flatten against door 42 to sandwich door 42 therebetween to hold it closed and apply tension to guideline 43. Thus, members 41, 44 may be formed from a pliant PVC or other polymeric material having a soft, friction producing surface, but yet is stiff enough to securely hold door 42 in place during use.

The illustrations and examples provided herein are for explanatory purposes and are not intended to limit the scope of the appended claims.

I claim:

1. A door latch for a door having an inside and an outside face comprising: means to engage an outside door face, a guideline, said guideline connected to said outside door face engaging means, and a means to engage an inside door face, said inside door face engaging means slidably positioned on said guideline, a means to adjustably secure said inside door face engaging means along said guideline, said securing means positioned on said guideline whereby the door can be maintained between said inside and said outside door face engaging means.

2. A door latch as claimed in claim 1 wherein said guideline is flexible.

3. A door latch as claimed in claim 1 wherein said outside door face engaging means comprises a disk.

4. A door latch as claimed in claim 1 wherein said inside door face engaging means comprises a disk.

5. A door latch as claimed in claim 1 wherein said inside and said outside door face engaging means are formed from a polymeric material.

6. A door latch as claimed in claim 1 wherein said outside door face engaging means comprises a friction producing surface.

7. A door latch as claimed in claim 1 wherein said inside door face engaging means comprises a friction producing surface.

8. A door latch as claimed in claim 1 wherein said outside door face engaging means is formed from a flexible material.

9. A door latch for positioning between a singable door having an inside and an outside face and a door jamb to maintain the door in a closed posture comprising: a disk to engage said outside door face and said jamb, a flexible guideline, said outside disk connected to said guideline, said guideline positionable between said door and said jamb, a disk to engage said inside door face, said inside disk slidably positioned on said guideline, a means to secure said inside disk along said guideline, said securing means adjustably positionable on said guideline.

10. A door latch as claimed in claim 9 wherein said inside and said outside disks have flat surfaces to engage said door.

11. A door latch as claimed in claim 2 wherein said inside and said outside disks each have a concave configuration.

* * * * *